US008686904B2

(12) United States Patent
Chen et al.

(10) Patent No.: US 8,686,904 B2
(45) Date of Patent: Apr. 1, 2014

(54) ANTENNA-EMBEDDED ELECTRONIC DEVICE CASE

(75) Inventors: Yu-Ju Chen, Taipei (TW); Shih-Wei Li, Taipei (TW); Der-Chung Hwang, Taipei (TW); Chen-Ta Hung, Taipei (TW)

(73) Assignee: Compal Electronics, Inc., Taipei (TW)

( * ) Notice: Subject to any disclaimer, the term of this patent is extended or adjusted under 35 U.S.C. 154(b) by 441 days.

(21) Appl. No.: 13/157,328

(22) Filed: Jun. 10, 2011

(65) Prior Publication Data

US 2011/0304514 A1 Dec. 15, 2011

Related U.S. Application Data

(60) Provisional application No. 61/354,690, filed on Jun. 14, 2010.

(51) Int. Cl.
*H01Q 1/24* (2006.01)

(52) U.S. Cl.
USPC ..... 343/702

(58) Field of Classification Search
USPC ..... 343/702
See application file for complete search history.

(56) References Cited

U.S. PATENT DOCUMENTS

| | | | | |
|---|---|---|---|---|
| 6,670,926 | B2 * | 12/2003 | Miyasaka | 343/702 |
| 7,429,954 | B2 * | 9/2008 | Doczy et al. | 343/702 |
| 8,102,321 | B2 * | 1/2012 | Chiang et al. | 343/702 |
| 2010/0289706 | A1 * | 11/2010 | Hsieh et al. | 343/702 |

* cited by examiner

*Primary Examiner* — Seung Lee
(74) *Attorney, Agent, or Firm* — CKC & Partners Co., Ltd.

(57) ABSTRACT

An antenna-embedded electronic device case includes an electrically-insulated case wall, a lower and an upper ground conductive layers, a lower and an upper electrically-insulated layer, and a continuous conductive layer. The lower ground conductive layer is in contact with the electrically-insulated case wall. The lower and upper electrically-insulated layers are sandwiched between the lower and upper ground conductive layers. The continuous conductive layer has a first portion sandwiched between the lower and upper electrically-insulated layers and a second portion protruding out to serve as an antenna radiator for transmitting or receiving electromagnetic signals.

20 Claims, 2 Drawing Sheets

ANTENNA-EMBEDDED ELECTRONIC DEVICE CASE

RELATED APPLICATIONS

This application claims priority to U.S. Provisional Application Ser. No. 61/354,690, filed Jun. 14, 2010, which is herein incorporated by reference.

BACKGROUND

1. Field of Invention

The present invention relates to an antenna-embedded case for a mobile communication terminal, a method for manufacturing the same.

2. Description of Related Art

Mobile communications terminals, such as cellular phones, personal digital assistants (PDAs) and notebook computers, are increasingly playing an important role in modern society. Recently, terminals with a variety of functions and designs have emerged due to the fast growing market for portable wireless terminals that separately or commonly use multiple bands, such as CDMA, GSM, or WIFI. In addition, the terminals are required to be further diversified in function while becoming smaller, slimmer and lighter. Therefore, techniques for reducing terminal volume while retaining antenna functions are currently in the spotlight.

As for antenna devices, rod antennas or helical antennas that protrude outside terminals are advantageous in terms of their onmnidirectional radiation; however, they are susceptible to damage when dropped, thereby undermining device portability. Therefore, studies are being conducted on antennas that are integrated with cases for mobile communication terminals.

SUMMARY

It is therefore an objective of the present invention to provide an antenna-embedded electronic device case.

In accordance with the foregoing and other objectives of the present invention, an antenna-embedded electronic device case includes an electrically-insulated case wall, a lower and an upper ground conductive layers, a lower and an upper electrically-insulated layer, and a continuous conductive layer. The lower ground conductive layer is in contact with the electrically-insulated case wall. The lower and upper electrically-insulated layers are sandwiched between the lower and upper ground conductive layers. The continuous conductive layer has a first portion sandwiched between the lower and upper electrically-insulated layers and a second portion protruding out to serve as an antenna radiator for transmitting or receiving electromagnetic signals.

According to an embodiment disclosed herein, a total thickness of the lower and upper ground conductive layers, the lower and upper electrically-insulated layers, and the continuous conductive layer is less than 0.5 mm.

According to another embodiment disclosed herein, the first portion of the continuous conductive layer has a first end connected with the second portion of the continuous conductive layer and a second opposite end connected with a circuit board.

According to another embodiment disclosed herein, the lower and an upper ground conductive layers are aluminum foils.

According to another embodiment disclosed herein, the lower and upper electrically-insulated layers are polyimide coatings.

According to another embodiment disclosed herein, the continuous conductive layer includes silver nanometer powders.

In accordance with the foregoing and other objectives of the present invention, an antenna-embedded electronic device case includes an electrically-insulated case wall, a first lower and a first upper electrically-insulated layers, a lower and an upper ground conductive layers, a second lower and a second upper electrically-insulated layers, and a continuous conductive layer. The first lower electrically-insulated layer is in contact with the electrically-insulated case wall. The lower and upper ground conductive layers is sandwiched between the first lower and upper electrically-insulated layer. The second lower and second upper electrically-insulated layers are sandwiched between the lower and upper ground conductive layers. The continuous conductive in layer has a first portion sandwiched between the second lower and upper electrically-insulated layers, and a second portion protruding out to serve as an antenna radiator for transmitting or receiving electromagnetic signals.

According to an embodiment disclosed herein, a total thickness of the lower and upper ground conductive layers, the first lower and upper electrically-insulated layers, the second lower and upper electrically-insulated layers, and the continuous conductive layer is less than 0.5 mm.

According to another embodiment disclosed herein, the first portion of the continuous conductive layer has a first end connected with the second portion of the continuous conductive layer and a second opposite end connected with a circuit board.

According to another embodiment disclosed herein, the lower and upper ground conductive layers are aluminum foils.

According to another embodiment disclosed herein, the first lower and upper electrically-insulated layers are polyimide coatings.

According to another embodiment disclosed herein, the second lower and upper electrically-insulated layers are polyimide coatings.

According to another embodiment disclosed herein, the continuous conductive layer includes silver nanometer powders.

In accordance with the foregoing and other objectives of the present invention, a method for manufacturing an antenna-embedded electronic device case includes the following steps. A lower and an upper ground conductive layers are fromed over an electrically-insulated case wall. A first lower and a first upper electrically-insulated layers are formed between the lower and upper ground conductive layers. The continuous conductive layer is formed to include a first portion sandwiched between the lower and upper electrically-insulated layers and a second portion protruding out to serve as an antenna radiator for transmitting or receiving electromagnetic signals.

According to an embodiment disclosed herein, a second lower and a second upper electrically-insulated layers are formed, wherein the second lower electrically-insulated layer is sandwiched between the electrically-insulated case wall and the lower ground conductive layer, and the second upper electrically-insulated layer is in contact with the upper ground conductive layer.

According to another embodiment disclosed herein, the lower and upper ground conductive layers are made from aluminum foils.

According to another embodiment disclosed herein, the continuous conductive layer is formed by sputter deposition, vapor deposition, electroplating, printing, or coating.

According to another embodiment disclosed herein, the continuous conductive layer includes silver nanometer powders.

According to another embodiment disclosed herein, the first lower and upper electrically-insulated layers are polyimide coatings.

According to another embodiment disclosed herein, the second lower and upper electrically-insulated layers are polyimide coatings.

Thus, the antenna-embedded electronic device case has its antenna radiator and the conductive core of the coaxial cable manufactured by common processes and common materials so as to form a continuous conductive layer. Besides, the antenna radiator and the coaxial cable are integrally formed on the electrically-insulated case wall such that no additional fastener is needed to secure them and the thickness of the electronic device case can be greatly reduced.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
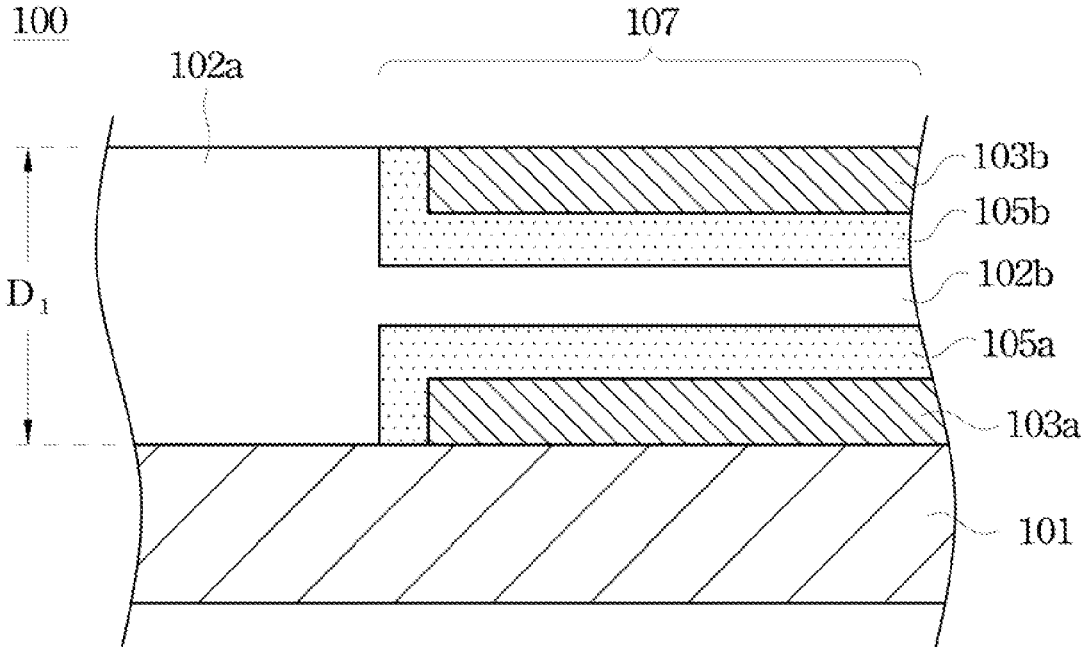
FIG. 1 illustrates a cross-sectional view of an antenna-embedded electronic device case according to a preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 illustrates a cross-sectional view of an electronic device case with an antenna structure according to a preferred embodiment of this invention. The electronic device case 100 is designed to be equipped with an antenna structure. The electronic device case 100 basically includes an electrically-insulated case wall 101, an antenna radiator 102*a* and a coaxial cable 107. The antenna radiator 102*a* and the coaxial cable 107 are integrally formed on the electrically-insulated case wall 101 such that no additional fastener is needed to secure the antenna radiator 102*a* and coaxial cable 107 to the electrically-insulated case wall 101. Thus, the thickness of the electronic device case can be greatly reduced.

In this embodiment, the coaxial cable 107 includes a lower and an upper ground conductive layers (103*a*, 103*b*), a lower and an upper electrically-insulated layer (105*a*, 105*b*), and a conductive core 102*b*. The lower ground conductive layer 103*a* is in contact with the electrically-insulated case wall 101. The lower and upper electrically-insulated layers (105*a*, 105*b*) are formed to be sandwiched between the lower and upper ground conductive layers (103*a*, 103*b*). The conductive core 102*b* is formed to be sandwiched between the lower and upper electrically-insulated layers (105*a*, 105*b*).

In this embodiment, the antenna radiator 102*a* and the conductive core 102*b* of the coaxial cable 107 are a continuous conductive layer. The continuous conductive layer has a first portion (the conductive core 102*b*) sandwiched between the lower and upper electrically-insulated layers (105*a*, 105*b*) and a second portion protruding out to serve as an antenna radiator 102*a* for transmitting or receiving electromagnetic signals, e.g. a dipole antenna, mono-pole antenna, or planar inverted-F antenna. The conductive core 102*b* and the antenna radiator 102*a* are formed by common processes and common materials such that no electrical connector is needed to interconnect between them.

In this embodiment, a total thickness ($D_1$) of the lower and upper ground conductive layers (103*a*, 103*b*), the lower and upper electrically-insulated layers (105*a*, 105*b*), and the continuous conductive layer 102 is less than 1.0 mm, and preferably about 0.3 mm. Therefore, the antenna structure adds up a small thickness to the electrically-insulated case wall 101 so as to keep the case smaller, slimmer and lighter.

In this embodiment, the lower and upper ground conductive layers (103*a*, 103*b*) can be aluminum foils or other metallic foils. The lower and upper electrically-insulated layers (105*a*, 105*b*) can be polyimide coatings or other electrically-insulated layers. The continuous conductive layer 102 can be formed by sputter deposition, vapor deposition, electroplating, printing, or coating and its materials can be silver nanometer powders or other metallic nanometer powders.

Figure 2:
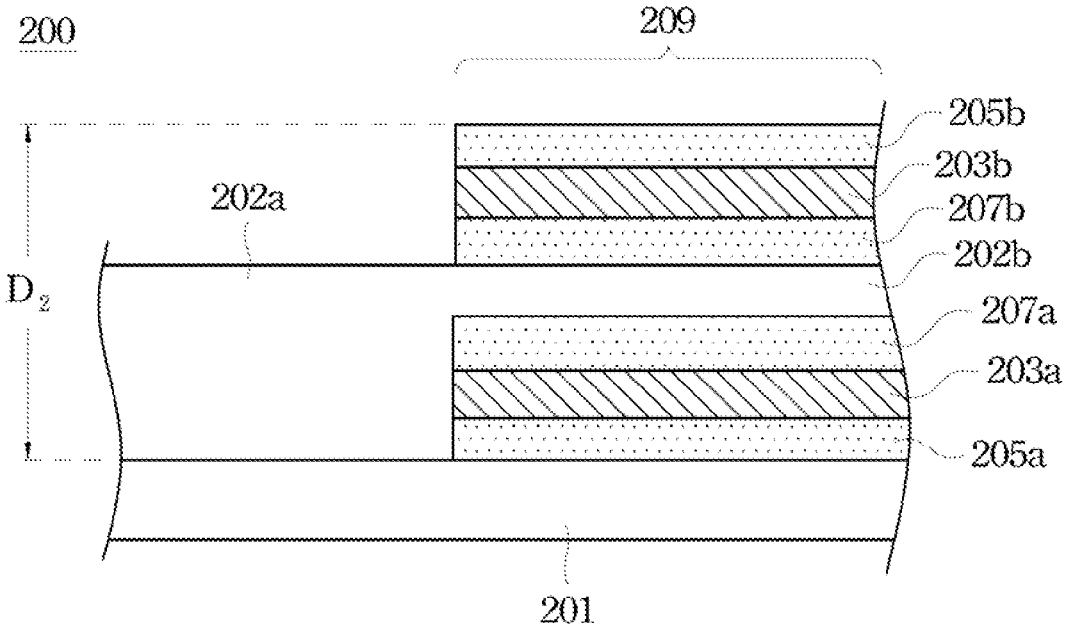
FIG. 2 illustrates a cross-sectional view of an antenna-embedded electronic device case according to another preferred embodiment of this invention.

FIG. 2 illustrates a cross-sectional view of an electronic device case with an antenna structure according to another preferred embodiment of this invention. The electronic device case 200 is also designed to be equipped with an antenna structure. The electronic device case 200 basically includes an electrically-insulated case wall 201, an antenna radiator 202*a* and a coaxial cable 209. The antenna radiator 202*a* and the coaxial cable 209 are integrally formed on the electrically-insulated case wall 201 such that no additional fastener is needed to secure the antenna radiator 202*a* and coaxial cable 209 to the electrically-insulated case wall 201. Thus, the thickness of the electronic device case can be greatly reduced.

In this embodiment, the coaxial cable 209 includes a lower and an upper electrically-insulated layers (205*a*, 205*b*), a lower and an upper ground conductive layers (203*a*, 103*b*), a lower and an upper electrically-insulated layers (207*a*, 207*b*), and a conductive core 202*b*. The lower electrically-insulated layer 205*a* is in contact with the electrically-insulated case wall 201. The lower and upper ground conductive layers (203*a*, 203*b*) are formed to be sandwiched between the lower and upper electrically-insulated layer (205*a*, 205*h*). The lower and upper electrically-insulated layers (207*a*, 207*b*) are formed to be sandwiched between the lower and upper ground conductive layers (203*a*, 203*b*). The conductive core 202*b* is formed to be sandwiched between the lower and upper electrically-insulated layers (207*a*, 207*b*).

In this embodiment, the antenna radiator 202*a* and the conductive core 202*b* of the coaxial cable 209 are a continuous conductive layer. The continuous conductive layer has a first portion (the conductive core 202*b*) sandwiched between the lower and upper electrically-insulated layers (207*a*, 207*b*) and a second portion protruding out to serve as an antenna radiator 202*a* for transmitting or receiving electromagnetic signals, e.g. a dipole antenna, mono-pole antenna, or planar inverted-F antenna. The conductive core 202*b* and the antenna radiator 202*a* are formed by common processes and common materials such that no electrical connector is needed to interconnect between them.

In this embodiment, a total thickness ($D_2$) of the lower and upper ground conductive layers (203*a*, 203*b*), the lower and upper electrically-insulated layers (205*a*, 205*b*), the lower and upper electrically-insulated layers (207*a*, 207*b*), and the continuous conductive layer 202 is less than 1.0 mm, and preferably about 0.3 mm. Therefore, the antenna structure adds up a small thickness to the electrically-insulated case wall 201 so as to keep the case smaller, slimmer and lighter.

In this embodiment, the lower and an upper ground conductive layers (203*a*, 203*b*) can be aluminum foils or other metallic foils. The lower and upper electrically-insulated layers (205*a*, 205*b*, 207*a*, 207*b*) can be polyimide coatings or other electrically-insulated layers. The continuous conductive layer 202 can be formed by sputter deposition, vapor deposition, electroplating, printing, or coating and its materials can be silver nanometer powders or other metallic nanometer powders.

Figure 3:
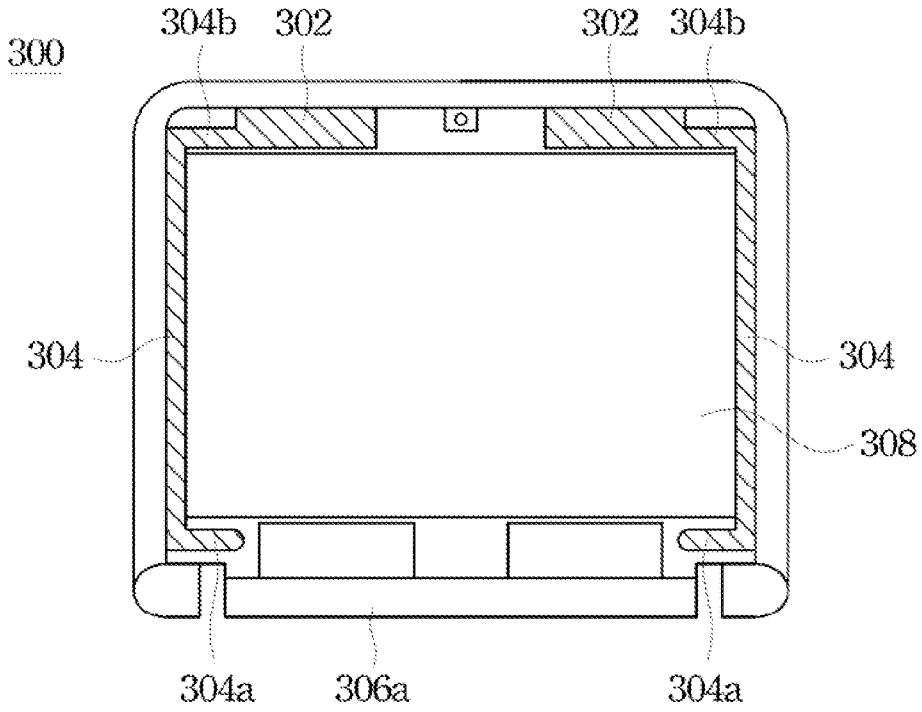
FIG. 3 illustrates a planar view of an antenna-embedded electronic device case according to still another preferred embodiment of this invention.
Figure 4:
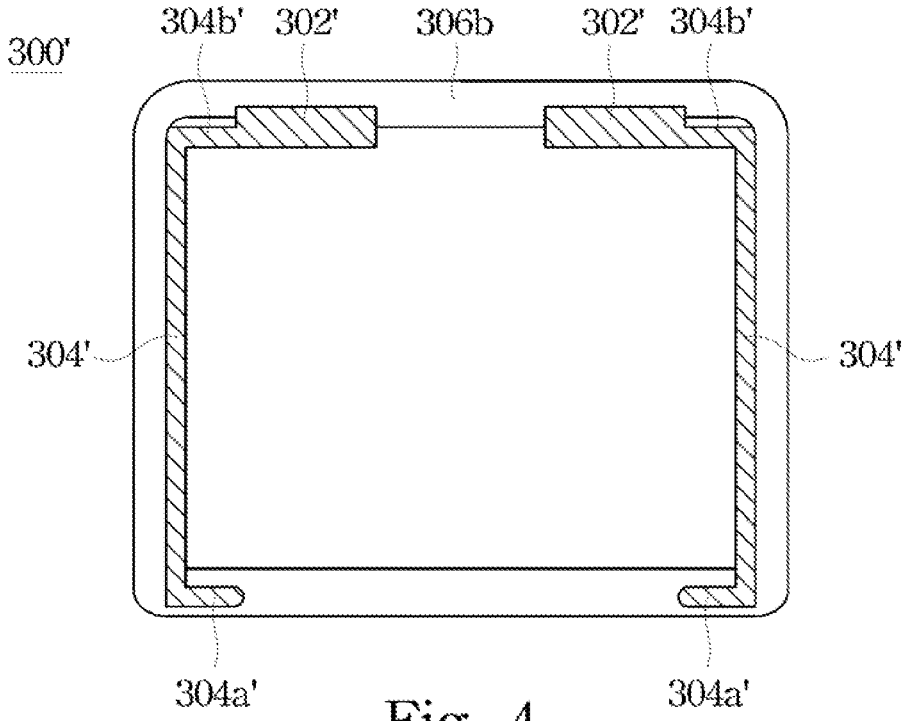
FIG. 4 illustrates a planar view of an antenna-embedded electronic device case according to still another preferred embodiment of this invention.

Referring to FIG. 3 and FIG. 4, which respectively illustrate a planar view of an electronic device case with an antenna structure according to still another preferred embodiment of this invention.

In FIG. 3, the antenna structure is integrally formed on a bezel 306*a* of a display portion for an electronic device 300. Two antenna radiators 302 are located at an upper side of the bezel 306*a*. Two coaxial cables 304 are arranged around a display panel 308, which is fastened within the bezel 306*a*. Each coaxial cable 304 has an end 304*b* connected with the antenna radiator 302 and an opposite end 304*a* connected with a circuit board (not illustrated in the drawings).

In FIG. 4, the antenna structure is integrally formed on a back cover 306*b* of a display portion for an electronic device 300'. Two antenna radiators 302' are located at an upper side of the back cover 306*b*. Two coaxial cables 304' are arranged along two opposite edges 304' of the back cover 306*b*. Each coaxial cable 304' has an end 304*b'* connected with the antenna radiator 302' and an opposite end 304*a'* connected with a circuit board (not illustrated in the drawings).

Because no electrical connector is needed to interconnect between the antenna radiators (302, 302') and coaxial cables (304, 304'), the resistance between the antenna radiators (302, 302') and coaxial cables (304, 304') can be greatly reduced, thereby reducing a return loss in transmitting radio signals.

Although the present invention has been described in considerable detail with reference to certain preferred embodiments thereof, other embodiments are possible. Therefore, their spirit and scope of the appended claims should no be limited to the description of the preferred embodiments container herein.

According to the above-discussed embodiments, the antenna-embedded electronic device case has its antenna radiator and the conductive core of the coaxial cable manufactured by common processes and common materials so as to form a to continuous conductive layer. Besides, the antenna radiator and the coaxial cable are integrally formed on the electrically-insulated case wall such that no additional fastener is needed to secure them and the thickness of the electronic device case can be greatly reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device case with a planar antenna comprising:

an electrically-insulated case wall;

a lower and an upper ground conductive layers, the lower ground conductive layer is in contact with the electrically-insulated case wall;

a lower and an upper electrically-insulated layers being sandwiched between the lower and upper ground conductive layers; and a continuous conductive layer haying a first portion sandwiched between the lower and upper electrically-insulated layers and a second portion protruding out to serve as an antenna radiator for transmitting or receiving electromagnetic signals.

2. The electronic device case of claim 1 , wherein a total thickness of the lower and upper ground conductive layers, the lower and upper electrically-insulated layers, and the continuous conductive layer is less than 1.0 mm.

3. The electronic device case of claim 1, wherein the first portion of the continuous conductive layer has a first end connected with the second portion of the continuous conductive layer and a second opposite end connected with a circuit board.

4. The electronic device case of claim 1, wherein the lower and an upper ground conductive layers comprise an aluminum foil.

5. The electronic device case of claim 1, wherein the lower and upper electrically-insulated layers comprise polyimide coatings.

6. The electronic device case of claim 1, wherein the continuous conductive layer comprises silver nanometer powders.

7. An electronic device case with a planar antenna comprising:

an electrically-insulated case wall;

a first lower and a first upper electrically-insulated layers, the first lower electrically-insulated layer is in contact with the electrically-insulated case wall;

a lower and an upper ground conductive layers being sandwiched between the first lower and upper electrically-insulated layer;

a second lower and a second upper electrically-insulated layers, being sandwiched between the lower and upper ground conductive layers; and a continuous conductive layer having a first portion sandwiched between the second lower and upper electrically-insulated layers and a second portion protruding out to serve as an antenna radiator for transmitting or receiving electromagnetic signals.

8. The electronic device case of claim 7, wherein a total thickness of the lower and upper ground conductive layers, the first lower and upper electrically-insulated layers, the second lower and upper electrically-insulated layers, and the continuous conductive layer is less than 1.0 mm.

9. The electronic device case of claim 7, wherein the first portion of the continuous conductive layer has a first end connected with the second portion of the continuous conductive layer and a second opposite end connected with a circuit board.

10. The electronic device case of claim 7, wherein the lower and tipper ground conductive layers comprise an aluminum foil.

11. The electronic device case of claim 7, wherein the first lower and upper electrically-insulated layers comprise polyimide coatings.

12. The electronic device case of claim 7, wherein the second lower and upper electrically-insulated layers comprise polyimide coatings.

13. The electronic device case of claim 7, wherein the continuous conductive layer comprises silver nanometer powders.

14. A method for manufacturing a planar antenna of an electronic device comprising:

forming a lower and an upper ground conductive layers over an electrically-insulated case wall;

forming a first lower and a first upper electrically-insulated layers between the lower and upper ground conductive layers; and forming a continuous conductive layer, wherein the continuous conductive layer comprises a first portion sandwiched between the lower and upper electrically-insulated layers and a second portion protruding out to serve as an antenna radiator for transmitting or receiving electromagnetic signals.

15. The method of claim 14, further comprising:

forming a second lower and a second upper electrically-insulated layer, wherein the second lower electrically-insulated layer is sandwiched between the electrically-insulated case wall and the lower ground conductive layer, and the second upper electrically-insulated layer is in contact with the upper ground conductive layer.

16. The method of claim 15, wherein the second lower and upper electrically-insulated layers comprise polyimide coatings.

17. The method of claim 14, wherein the lower and upper ground conductive layers are made from aluminum foils.

18. The method of claim 14, wherein the continuous conductive layer is formed d by sputter deposition, vapor deposition, electroplating, printing, or coating.

19. The method of claim 14, wherein the continuous conductive layer comprises silver nanometer powders.

20. The method of claim 14, wherein the first lower and upper electrically-insulated layers comprise polyimide coatings.

* * * * *